US005533284A

United States Patent [19]

Esch

[11] Patent Number: 5,533,284

[45] Date of Patent: Jul. 9, 1996

[54] EARTH-MOVING MACHINE WITH REVOLVING TOWER AND ADJUSTABLE COUNTERWEIGHT

[75] Inventor: Uwe Esch, Dortmund, Germany

[73] Assignee: O&K Orenstein & Koppel AG, Berlin, Germany

[21] Appl. No.: 331,508

[22] PCT Filed: Oct. 1, 1993

[86] PCT No.: PCT/EP93/02691

§ 371 Date: Oct. 20, 1994

§ 102(e) Date: Oct. 20, 1994

[87] PCT Pub. No.: WO94/08101

PCT Pub. Date: Apr. 14, 1994

[30] Foreign Application Priority Data

Oct. 7, 1992 [DE] Germany ..... 42 33 730.5

[51] Int. Cl.[6] ..... B66C 23/72

[52] U.S. Cl. ..... 37/348; 414/719

[58] Field of Search ..... 37/347, 348; 212/198, 212/195, 197; 414/719

[56] References Cited

U.S. PATENT DOCUMENTS

| | | | |
|---|---|---|---|
| 2,408,500 | 10/1946 | West . | |
| 3,653,486 | 4/1972 | McLean et al. | 414/719 X |
| 4,172,529 | 10/1979 | Bryan, Jr. | 414/719 X |
| 4,402,413 | 9/1983 | Sickler | 414/719 X |
| 4,494,906 | 1/1985 | Brocklebank et al. | 414/719 |
| 4,557,390 | 12/1985 | Mick | 414/719 X |
| 4,679,336 | 7/1987 | Brocklebank et al. | 414/719 X |
| 4,773,814 | 9/1988 | Brocklebank et al. | 414/719 X |

FOREIGN PATENT DOCUMENTS

| | | |
|---|---|---|
| 1008407 | 4/1977 | Canada . |
| 8219210 | 5/1983 | France . |
| 1288993 | 2/1969 | Germany . |
| 2134530 | 1/1972 | Germany . |
| 1917434 | 6/1977 | Germany . |
| 3232163 | 3/1984 | Germany . |
| 1110475 | 4/1966 | United Kingdom . |

*Primary Examiner*—Terry Lee Melius
*Assistant Examiner*—Robert Pezzuto
*Attorney, Agent, or Firm*—Spencer & Frank

[57] ABSTRACT

An earth-moving machine, includes a bogie. A superstructure is supported on the bogie. The superstructure is divided into a stationary part, and a pivotable part swivelable about a horizontal axis. A working attachment is connected one of directly and indirectly to the pivotable part. A counterweight is attached to the pivotable part.

20 Claims, 2 Drawing Sheets

EARTH-MOVING MACHINE WITH REVOLVING TOWER AND ADJUSTABLE COUNTERWEIGHT

BACKGROUND OF THE INVENTION

The invention relates to an earth-moving machine, such as a cable dredger, hydraulic dredger, ditcher or backhoe, loading shovel or front loader or the like, with a bogie optionally connected to a moving gear, on which a superstructure that is optionally pivotable about a vertical axis is supported, on which among other elements a working gear or attachment, operatively connected to a counterweight, is provided.

German Patent Disclosure DE-OS 32 32 163 relates to a hydraulically driven digger or dredger that, to increase its performance with neutralization of its own weight, has mechanical-hydraulic working elements, such as compression springs, leaf springs, tension springs or counterweights, by which the intrinsic weight of the cantilever arm together with the attachment (shovel, gripper, chisel and other parts) is cancelled out with respect to force. An extension can be attached to the cantilever suspension and a counterweight mounted on it, whose weight depends on the size of the cantilever arm and gear. By neutralizing the intrinsic weight of the cantilever arm, the basically necessary transport and the requisite associated attendant important of energy is now no longer necessary. Not only does this free up additional performance capacity, but considerable driving energy can also be spared, while the work done remains the same.

The gear and counterweight here are supported on a common support block on the superstructure, and a hydraulic ram is provided between the superstructure and the gear, the ram optionally cooperating with a spring. A disadvantage here proves to be that because of the geometrical arrangement and the pivotability of the counterweight above the superstructure, the stability of the equipment with the counterweight raised is fundamentally questionable.

Examined German Patent Disclosure DE-AS 19 17 434 relates to an earth-moving machine, such as a digger or dredger or the like, with a rotary device, disposed on a moving gear, that carries a revolving tower containing the working device and a counterweight. A vertically oriented adjustable parallelogram support is disposed between the rotary device and the revolving tower. The support it comprises two parallel arms, pivotably connected on one end to a platform located on the rotary device and on the other to the revolving tower. Between one of the arms and the platform or the revolving tower, a piston-cylinder arrangement is provided. The parallelogram and thus the shifting of the counterweight or components of the superstructure are adapted each time to a given working situation or transport purpose, so that in the final analysis, since an operative connection between the gear and the counterweight is lacking, the engineering expense is relatively high.

SUMMARY OF THE INVENTION

The object of the invention is to improve an earth-moving machine in such a way that the potential energy of the particular working cycle is stored by simple constructive means, so that it can be employed usefully again in the next cycle.

According to the invention, this object is attained in that the superstructure is divided into a stationary part, optionally rotatable about the vertical axis, and a part swivelable about a horizontal axis, wherein the swivelable part is connected indirectly or directly to the working gear.

The subject of the invention is usefully employed in all earth-moving machines, in particular cable dredgers, hydraulic dredgers, backhoes and front loaders. The rocker, depending on the particular equipment, is either supported as an integral component on a support block, or else a division of the gear and pivotable section is made, each section then being supported separately on a support block and connected to one another by suitable connecting elements, such as cables, chains or hydraulic cylinders.

The subject of the invention is shown in terms of an exemplary embodiment in the drawing and will be described as follows.

BRIEFS DESCRIPTION OF THE DRAWINGS

Shown are:

FIGS. 1 and 2—front loader with various positions of the gear, in the form of a basic sketch;

FIGS. 3 and 4—a basic sketch of a backhoe with various positions for the gear.

DETAILED DESCRIPTION OF THE INVENTION

Figure 1:
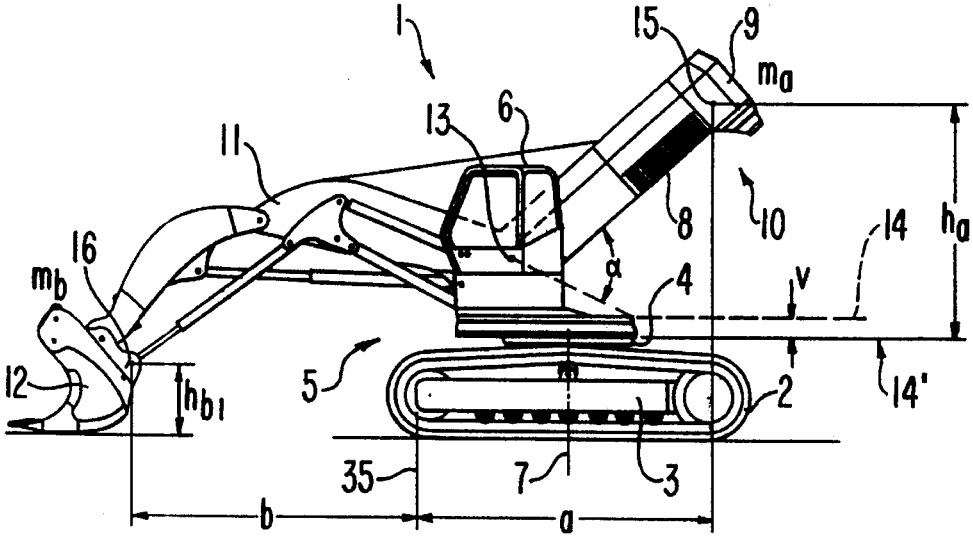
Figure 2:
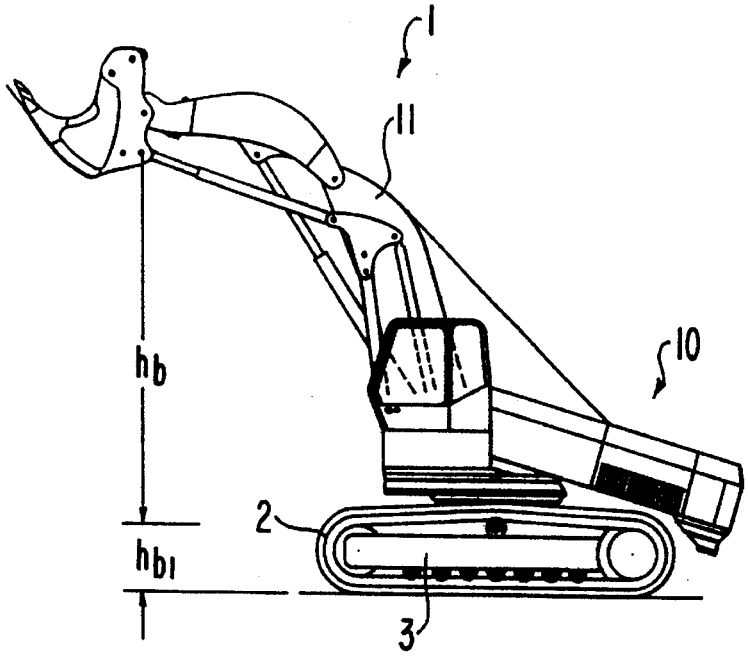

FIGS. 1 and 2 as basic sketches show a hydraulic dredger 1 embodied as a front loader, which essentially is made up of the following components: a bogie 3, connected to a track-type moving gear 2, a slewing ring 4, a stationary superstructure section 5 with a cab 6, with the superstructure section 5 being pivotable relative to the bogie 3 about the vertical axis 7. A pivotable section (swivelable component) 10, comprising components in the form of a motor 8, a counterweight 9, and hydraulics (not shown here), is connected, forming a kind of rocker, to the working gear or attachment (i.e., operating attachment) 11, which carries the loading bucket 12 in the region of its free end. The components 10 and 11 are thus pivotable about a common horizontal axis 13, merely suggested here, but at the same time are rotatable together with the stationary superstructure section 5 about the vertical axis 7. Since the swivelable component 11 comprises the counterweight 9, the counterweight is movable around the horizontal axis along a circular arc having a predetermined radius when the swivelable component is pivoted. The zero position of the pivotable section 10 is represented here by the dashed line 14, and the vertical distance between this zero position 14 and the top edge 14' of the bogie 3 is marked V. Because of this vertical distance, a pivot angle $\alpha$ of more than 45° is attainable.

The dividing of the pivot angle $\alpha$ here is approximately ½; that is, the pivot angle of the pivotable section 10 upward, with respect to the zero position 14, is twice as high as downward. The distance a between the center of gravity 15 of the pivotable section 10 and the tilt axis, in this view shown as a tilting point 35, forms the ratio $$a/b>1$$

with respect to the distance b of the center of gravity 16 of the gear 11 from the tilt point 35.

The height to weight ratio of the pivotable section 10 to the gear 11 in this example is approximately equal to the value $$h_1 \times m_a / h_b \times m_b = \text{approximately } 0.7,$$

wherein $h_a$ is a distance between the center of gravity (15) of the pivotable part (10, 23), in a raised position, and a horizontal zero position of the pivotable part (10, 23); $m_a$ is the mass of the pivotable part (10; 23); $h_b$ is a distance between the center of gravity (16) of the working attachment (11, 26) in a position of repose, and the center of gravity (16) of the working attachment in a raised position (11, 23); and $m_b$ is the mass of the working attachment (11, 26), including a load carried by it.

Figure 3:
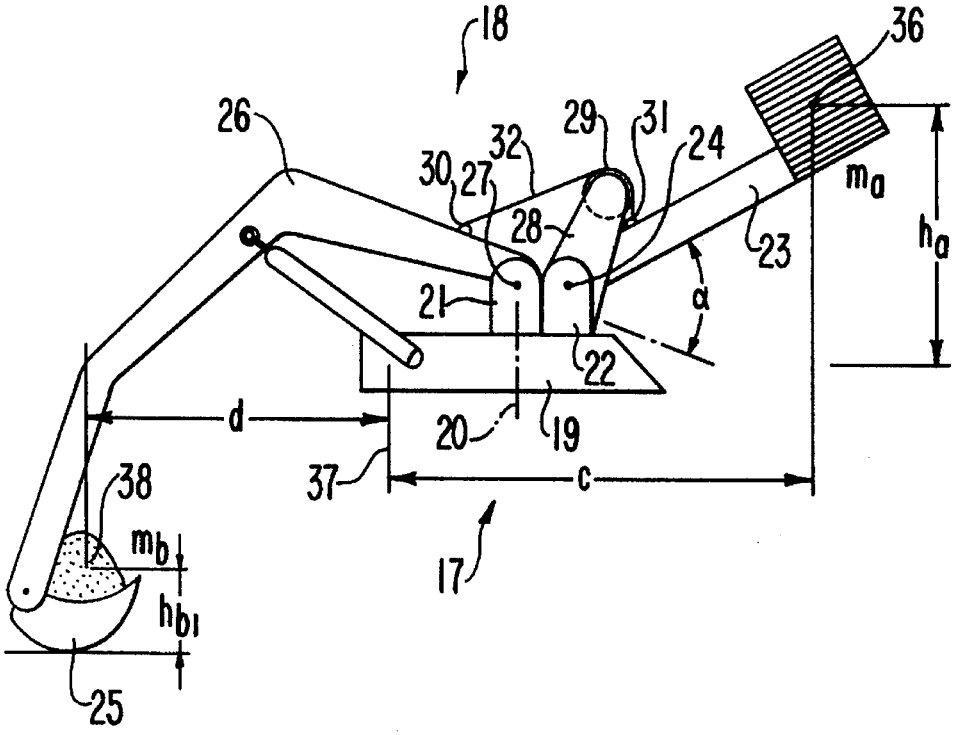
Figure 4:
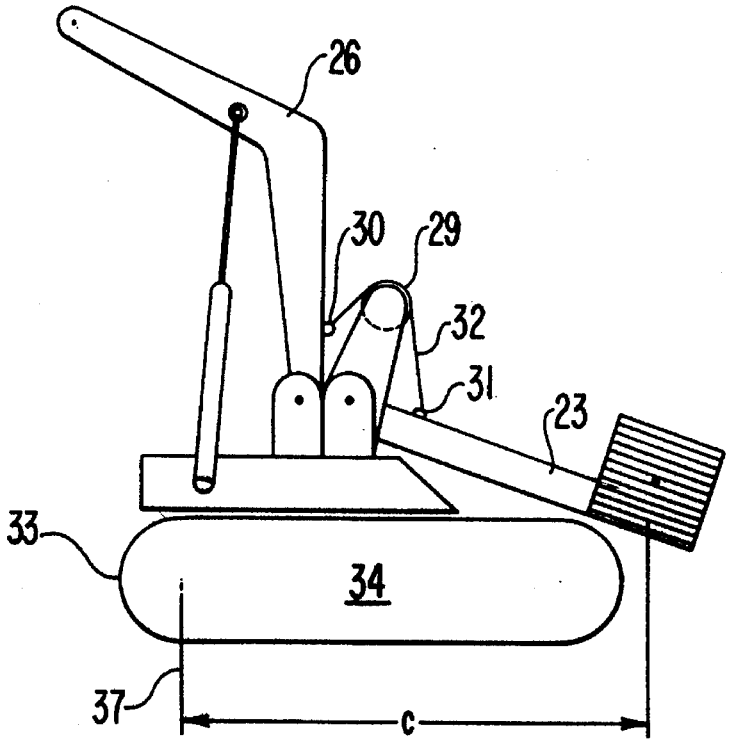

FIGS. 3 and 4 as basic sketches show the superstructure region 17 of a backhoe 18. The superstructure region 17 is formed of a stationary section 19, rotatable about a vertical axis 20 that is merely suggested in the drawing, which section is provided with two support blocks 21, 22. The pivotable section 23, merely suggested here, is pivotable about the horizontal axis 24 of the support block 22, and the attachment 26 cooperating with the excavator bucket 25 is pivotable about the horizontal axis 27 of the support block 21. A raised region 28 is provided in the region of the support block 22; this region carries a deflection disk 29, about which a cable 32, secured at deflection i.e., articulation points 30 and 31 to the attachment 26 and the pivotable section 23, respectively, can be deflected. Alternatively, a hydraulic cylinder can be located in a region between the stationary part of the superstructure (5) and the pivotable part, and be connected to a hydraulic ram used for actuating the working attachment. The distance c of the center of gravity 36 of the pivotable section 23 from the tilt axis, shown in this view as a tilt point 37, forms the ratio $$c/d>1$$

with respect to the distance d of the center of gravity 38 of the attachment 26 from the tilt point 37.

Once again, the height to weight ratio of the pivotable section 23 to the attachment 26 is $$h_a \times m_a / h_b \times m_b = \text{approximately } 0.7$$

and the pivotable angle $\alpha$ is approximately 45° then.

FIG. 4 also, in suggested fashion, shows the bogie 34 equipped with a track-type moving gear 33.

I claim:

1. An earth-moving machine, comprising:

a bogie;

a superstructure supported on said bogie, and being divided into a stationary part, and a pivotable part pivotable about a horizontal axis relative to said stationary part;

a working attachment connected to said pivotable part; and a counterweight attached to said pivotable part.

2. The machine of claim 1, wherein the stationary part comprises a slewing ring, and at least one of a support block, and cab positioned on top of said bogie via the slewing ring.

3. The machine of claim 1, wherein the pivotable part comprises at least one of a motor and hydraulics.

4. The machine of claim 1, wherein the pivotable part forms a vertical spacing between a horizontal zero position of said pivotable part, and a top of said bogie so that said pivotable part is pivotable about a pivot angle ($\alpha$) of at least 45°.

5. The machine of claim 4, wherein a bisecting of the pivot angle ($\alpha$), with respect to the horizontal zero position, meets the following formula $$\alpha_1/\alpha_2 = 1/2,$$

in which $\alpha_1$ is the pivot angle of the pivotable part upward above the horizontal zero position, and $\alpha_2$ is the pivot angle of the pivotable part downward below the horizontal zero position.

6. The machine of claim 1, wherein said machine comprises a front loader, and wherein a distance (a) between the center of gravity of the pivotable part and a tilt axis of said front loader, and a distance (b) between the center of gravity of the working attachment and the tilt axis forms a ratio of $$a/b \geqq 1.$$

7. The machine of claim 1, wherein said machine comprises a ditcher, and wherein a distance (c) between the center of gravity of the pivotable part and a tilt axis of said ditcher, and a distance (d) between the center of gravity of the working attachment and the tilt axis forms a ratio of $$c/d \geqq 1.$$

8. The machine of claim 1, wherein a height to weight ratio of the pivotable part to the working attachment is $$h_a \times m_a / h_b \times m_b = \text{approximately } 0.7, \text{ in which}$$

$h_a$ is a distance between the center of gravity of the pivotable part in a raised position, and a horizontal zero position of the pivotable part;

$m_a$ is the mass of the pivotable part;

$h_b$ is a distance between the center of gravity of the working attachment in a position of repose, and the center of gravity of the working attachment in a raised position; and $m_b$ is the mass of the working attachment, including a load carried by it.

9. The machine of claim 1, wherein the working attachment is directly connected to the pivotable part, forming a rocker pivotable about the horizontal pivot axis in a region of a common support block.

10. The machine of claim 1, wherein the stationary part comprises two separate support blocks, said working attachment being pivotally supported by one support block, and said pivotable part being pivotally supported by the other support block; and connecting means for connecting the working attachment to the pivotable part to form a rocker.

11. The machine of claim 10, wherein said connecting means comprises a cable connected to the working attachment and the pivotable part at respective articulation points, and means disposed in a region of one of the support blocks for deflecting the cable.

12. The machine of claim 10, wherein said connecting means comprises at least one hydraulic cylinder located in a region between the stationary part of the superstructure and the pivotable part, and being operatively connected to a hydraulic ram for actuating the working attachment.

13. An earth-moving machine, comprising:

a superstructure divided into a stationary component, and a swivelable component pivotable about a horizontal axis relative to said stationary component, said swivelable component comprising a counterweight movable around the horizontal axis along a circular arc having a predetermined radius when said swivelable component is pivoted; and an operating attachment connected one of indirectly and directly to said swivelable part, whereby pivoting of said swivelable component causes said operating attachment to move.

14. The earth-moving machine defined in claim 13, wherein said counterweight is operatively connected to said working attachment.

15. The earth-moving machine defined in claim 13, being comprised of one of a cable dredger, hydraulic dredger, ditcher and front loader.

16. The earth-moving machine defined in claim 13, further comprising a bogie; said superstructure being supported on said bogie.

17. The earth-moving machine defined in claim 16, wherein said bogie is operatively connected to moving means for moving said earth-moving machine.

18. The earth-moving machine defined in claim 13, wherein said superstructure is rotatable about a vertical axis.

19. The earth-moving machine defined in claim 1, being comprised of one of a cable dredger, hydraulic dredger, ditcher and front loader.

20. The earth-moving machine defined in claim 1, wherein said superstructure is rotatable about a vertical axis.

* * * * *